United States Patent [19]

Capone

[11] Patent Number: 4,474,549

[45] Date of Patent: Oct. 2, 1984

[54] COMBUSTION AIR TRIM CONTROL METHOD AND APPARATUS

[75] Inventor: David M. Capone, Oakmont, Pa.

[73] Assignee: Ametek, Inc., New York, N.Y.

[21] Appl. No.: 360,576

[22] Filed: Mar. 22, 1982

[51] Int. Cl.[3] ..... F23N 5/00

[52] U.S. Cl. ..... 431/12; 431/20; 431/76; 431/90; 236/15 E

[58] Field of Search ..... 431/12, 20, 76, 90; 236/15 E

[56] References Cited

U.S. PATENT DOCUMENTS

| | | | |
|---|---|---|---|
| 1,690,329 | 11/1928 | Baxter | 431/28 |
| 1,849,162 | 3/1932 | Wilhjelm et al. | 236/15 R |
| 2,122,683 | 7/1938 | Faverty | 431/39 |
| 2,290,770 | 7/1942 | Schumann | 415/49 |
| 3,549,089 | 12/1970 | Hamlett | 236/15 E |
| 4,157,238 | 6/1979 | Van Berkum | 431/12 |
| 4,249,886 | 2/1981 | Bush | 431/90 |
| 4,264,297 | 4/1981 | Van Berkum | 431/76 |

*Primary Examiner*—Carroll B. Dority, Jr.
*Attorney, Agent, or Firm*—Stanley J. Price, Jr.; John M. Adams

[57] ABSTRACT

Air trim control actuator mechanically connects a fuel flow device to an air flow device for setting the air to fuel ratio in combustion apparatus. An air to fuel ratio control unit is responsive to electrical input signals from an oxygen sensor that monitors the combustion products in the stack emissions. The air trim actuator includes a pivotally mounted input arm that is mechanically connected to the control unit and is pivoted to a preselected position corresponding to the selected boiler load. The input arm is connected by a link to an output arm which is pivoted through a preselected range of movement to control the position of the damper. The output arm has an elongated arcuate slot for receiving the end of the link. The output arm is pivoted to a position corresponding to the pivoted position of the input arm for selectively positioning the damper to provide air flow to the boiler for the desired air/fuel ratio. Adjustments made to the boiler load automatically adjust the damper position for insuring that the proper air/fuel ratio is attained. The position of the link in the slot of the output arm is adjustable by a correction signal transmitted by the control unit to a motor, or the like, which moves the position of the second end of the link in the slot of the output arm. Thus, the range of movement of the output arm is adjustable in relation to the range of movement of the input arm. By adjusting the position of the end of the link in the slot in response to variations in the boiler load condition or other factors that effect the air/fuel ratio, the damper is automatically moved to continuously maintain the optimum combustion conditions.

17 Claims, 11 Drawing Figures

COMBUSTION AIR TRIM CONTROL METHOD AND APPARATUS

BACKGROUND OF THE INVENTION

1. Field of the Invention

This invention relates to a combustion air trim control method and apparatus and more particularly, to an actuator for automatically adjusting the ratio between the flow of air and the flow of fuel to the burner of combustion apparatus.

2. Description of the Prior Art

In order to attain optimum fuel economy in the operation of a boiler, it is well known that the air/fuel ratio must be continuously adjusted in order to correct for changes in fuel heat values, oil viscosity, gas density, variations in air temperature and humidity, burner condition, fuel temperature changes, fuel pressure changes, linkage wear, and other factors. It has been found that one of the requirements for achieving optimum fuel economy is controlling the amount of excess air in a boiler. It is a common practice to operate boilers with 15% to 35% more air than is actually required. Excess air flow of this degree reduces flame temperature and carries usable heat out of the process.

A boiler operation must be "continuously tuned" by adjustments to the air/fuel ratio to compensate for changes in the above factors effecting optimum combustion. A known method of continuously adjusting the air/fuel ratio in a combustion process is by interconnecting the fuel control device with the air flow control device by a mechanical linkage.

U.S. Pat. Nos. 4,157,238 and 4,264,297 disclose an actuator which is adjustable to provide the desired air to fuel ratio throughout the operating range of the combustion apparatus. The disclosed linkage utilizes a jackshaft system for interconnecting the fuel valve with the damper. The interconnection also includes variable linkage means between the jackshaft and one of the flow control devices, either the fuel valve or the damper. The variable linkage responds to a control signal to change the calibration between the control devices in order to compensate for changes in the operating conditions enumerated above. The variable linkage means includes a lever having a length adjustable by a piston cylinder assembly. This arrangement permits changes to be made in the radius length of the lever arm. In addition, a link connecting the jackshaft through the lever arm to one of the flow control devices is also changeable in length. In this manner, the calibrated linkage relationship between the fuel valve and the damper is adjustable to compensate for changes in the operating conditions.

One of the problems encountered with the variable length-type linkage connections between a jackshaft and an air or fuel flow control device is an incomplete response or a non-response to the signal for actuating a change in the length of a plurality of levers and connecting links. When a change in the calibration between the fuel valve and the damper is required, unless the precise changes in the lengths of the adjustable interconnecting levers and links is made simultaneously, the recalibration will not be successfully completed. For example, if the length of one lever is changed and the corresponding change in the length of a connecting link to one of the flow control devices is not made, the system, rather than being tuned, becomes more inefficient. This can result in the air/fuel ratio being set too low resulting in incomplete combustion with unburned fuel carried away in the flue gases or too high resulting in excess air flow with heat being carried away in the flue gases.

While it has been suggested by the prior art devices to continuously adjust combustion apparatus to maintain an optimum air/fuel ratio by recalibrating the interconnecting linkage between the fuel flow and air flow control devices, the known control systems utilize a plurality of component parts which are independently controlled. They are subject to malfunction if the required adjustments to the components are not made. Therefore, there is need for combustion air trim control apparatus having a mechanical linkage that interconnects the fuel and air flow control devices in a manner which efficiently and reliably adjusts the linkage connection in response to a rapid change in the boiler operating conditions.

SUMMARY OF THE INVENTION

In accordance with the present invention, there is provided an actuator for automatically adjusting the ratio between the flow of air and the flow of fuel in combustion apparatus that includes an input arm responsive to an input signal. The input arm has a first end portion and a second end portion. The first end portion is pivotally mounted for arcuate movement of the input arm. An output arm for generating the output control signal is positioned adjacent to the input arm. The output arm has a first end portion and a second end portion. The output arm first end portion is pivotally mounted for arcuate movement of the output arm. The output arm has a slot of a preselected length spaced from the output arm first portion. A link extends between the input and output arms. The link has a first end portion pivotally connected to the input arm. The link has a second end portion. Means is provided for connecting the link second end portion to the output arm slot for movement of the link second end portion to a preselected position in the slot. The input arm is pivoted in response to an input signal to a preselected position to move the link and pivot the output arm to a preselected position for generating a corresponding output signal. The link second end portion is selectively positioned in the slot to adjust the range of movement of the output arm in relation to the range of movement of the input arm.

Actuator means applies an input signal to the input arm to move the input arm to a preselected pivoted position corresponding to a predetermined fuel flow in the combustion apparatus. The output arm is pivoted to a preselected position in response to movement of the input arm and the link. Movement of the output arm generates an output signal for providing a predetermined air flow to the combustion apparatus corresponding to the predetermined fuel flow.

The position of the input arm is responsive to the selected fuel flow. Therefore, the position of the input arm is representative of the selected rate of fuel flow. The output arm is connected to a damper that controls the flow of air to the combustion apparatus. Thus, the position of the output arm is responsive to the position of the input arm. A change in the position of the input arm for adjusting fuel flow results in a corresponding change in the position of the output arm to adjust the air flow in order to maintain the optimum air/fuel ratio in the combustion apparatus.

Preferably, the slot in the output arm has an arcuate configuration of a preselected length and a preselected radius. The slot radius is equal to the length of the link connecting the input arm to the output arm. The link second end portion is movable to a preselected position in the arcuate slot to control the range of movement of the output arm in response to the range of movement of the input arm. The point of connection of the link first end portion on the input arm is the center of the radius of the arcuate slot.

Accordingly, with this arrangement, the range of movement of the output arm is selectable to generate an output signal which is proportional to the input signal to the input arm. For example, with the link in a first position in the arcuate slot, the range of movement of the input arm corresponds to the range of movement of the output arm, and a one-to-one relationship exists between the input from the fuel flow control means to the output to the damper.

A change in the relationship between the range of movement of the input arm relative to the output arm is achieved by adjusting the position of the point of connection of the link in the arcuate slot of the output arm. Thus, movement of the link end portion from a first or centered position in the slot, for example, to a second or raised position in the slot permits the output arm to rotate less than the input arm so that the range of movement of the output arm is less than the range of movement of the input arm. Correspondingly, movement of the link second end portion to a third or lowered position in the slot permits the output arm to rotate more than the input arm so that the range of movement of the output arm is more than the range of movement of the input arm.

As determined by the desired fuel rate or boiler load conditions, the position of the link end portion in the arcuate slot of the output arm is selected so that the damper is positioned to provide an air flow that provides the optimum air/fuel ratio for a given boiler load. In the event of a change in the combustion operating conditions, the point of connection of the link end portion in the arcuate slot is adjusted to move the output arm either more or less than the input arm at any position in the rotation of the input and output arms.

Preferably, adjustments in the position of the link end portion in the arcuate slot is accomplished by a suitable power device, such as a motor.

Operation of the motor is controlled to provide the required correction in the air/fuel ratio upon a change in the combustion operating conditions. The degree of movement of the link end portion in the slot generated by the motor provides a correction to the air/fuel ratio to attain the optimum combustion conditions at all times.

Accordingly, the principal object of the present invention is to provide a combustion air trim control method and apparatus that maintains a preselected air/fuel ratio in combustion apparatus regardless of changes in the combustion operating conditions.

A further object of the present invention is to provide an actuator that automatically adjusts the ratio between the flow of air and the flow of fuel in a combustion apparatus where a change in boiler load conditions generates a change in the position of the damper to adjust the flow of air to maintain the optimum air/fuel ratio.

A further object of the present invention is to provide, in a boiler, an oxygen trim control that includes a mechanical amplifier mounted in the linkage between the fuel flow valve and the air damper and is operable to continuously maintain optimum combustion operating conditions by adjusting the air/fuel ratio to compensate for changes in the boiler operating conditions.

These and other objects of the present invention will be more completely disclosed and described in the following specification, the accompanying drawings and the appended claims.

DESCRIPTION OF THE PREFERRED EMBODIMENTS

Figure 1:
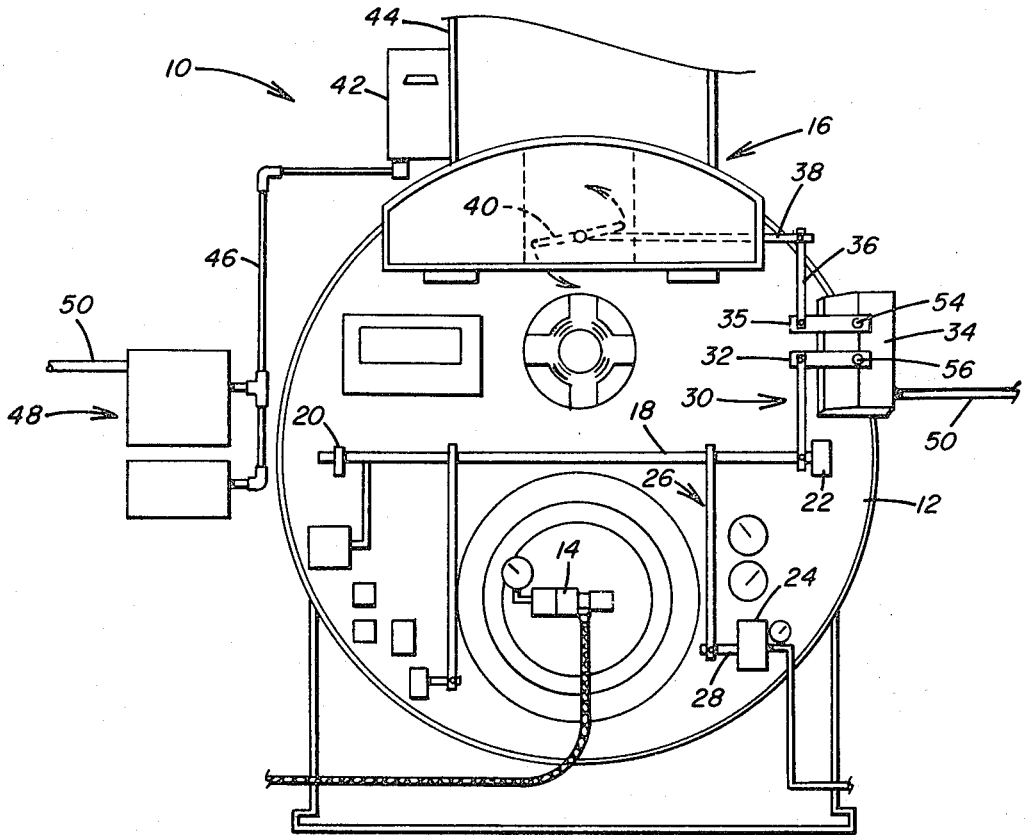
FIG. 1 is a schematic representation of a combustion system, illustrating air trim control apparatus in accordance with the present invention.
Figure 2:
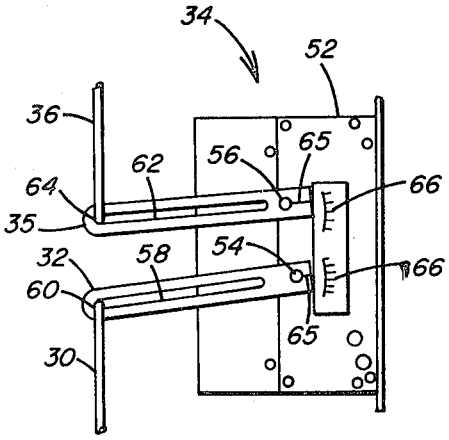
FIG. 2 is a schematic side view of a mechanical amplifier of the air trim control apparatus positioned in the linkage between a fuel flow control and an air flow control device of the combustion system shown in FIG. 1.

Referring to the drawings and, more particularly to FIG. 1, there is illustrated a combustion air trim control system, generally designated by the numeral 10 for use on a boiler 12 or other related combustion apparatus for continuously maintaining a preselected air/fuel ratio. The boiler 12 includes a fuel flow control device 14 or fuel valve for controlling the flow of fuel, such as gas or oil, to the combustion chamber of the boiler 12. An air flow control device, generally designated by the numeral 16, and including a conventional fan having a damper 40, regulates the flow of air to the combustion chamber for mixture with the fuel. The combustion air trim control system 10 continuously maintains the optimum air/fuel ratio in the combustion chamber. A jackshaft 18 is rotatably mounted at its end portions on bearings 20 and 22. A drive motor 24 is connected to the jackshaft 18 by a linkage, generally designated by the numeral 26. The drive motor 24 is electrically controlled by either a boiler technician or an automatic controller to select the desired air flow for a preselected boiler load or fuel rate to provide the optimum air/fuel ratio for maximum combustion efficiency at a minimum fuel consumption.

For a preselected rate of fuel flow to the combustion chamber, the drive motor 24 is actuated to rotate a motor output shaft 28 to rotate the jackshaft 18 through the linkage 26. The jackshaft 18 is, in turn, connected adjacent the bearing 22 to a linkage, generally designated by the numeral 30, to an input shaft 32 of an actuator, such as an oxygen trim control actuator 34. The actuator 34 is operable, in accordance with the present invention, to regulate the position of the damper 40 to thereby provide a volume of air flow to the combustion chamber of the boiler 12 to attain the optimum air/fuel ratio. The actuator 34 includes an output shaft 35 connected by linkages 36 and 38 to the damper 40 of the air flow control device 16. The details of the oxygen trim control actuator 34 are illustrated in greater detail in FIGS. 2–5 and will be described hereinafter in greater detail.

An oxygen sensor 42 of the type disclosed in U.S. Pat. No. 4,115,253, manufactured and sold by Ametek, Inc., Thermox Instruments Division, Pittsburgh, Pa., monitors the combustion products that flow through a stack 44 of the boiler 12. The oxygen sensor 42 transmits electrical signals through a circuit 46 to a programmable controller, generally designated by the numeral 48. The signals transmitted by the sensor 42 to the controller 48 are a measure of the amount of excess oxygen present in the boiler stack emissions.

The controller 48 is electrically connected (in a manner not shown) to the fuel valve 14 to compare the load indication from the fuel valve 14 with the excess oxygen in the stack emissions measured by the sensor 42. In the event the volume of excess oxygen in the stack emissions exceeds a preselected magnitude set for the controller 48, the controller 48 transmits a correction action signal through a circuit 50 to the trim control actuator 34 to generate a correction in the damper position between a zero input position and a full input position. Correcting the damper position adjusts the volume of air flow to the combustion chamber. As will be explained later in greater detail, the input signal from the controller 48 adjusts the position of the output shaft 35 to the damper 40 in relation to the position of the input shaft 32 corresponding to a preselected boiler load or fuel flow as determined by the input from the linkage 26 and drive motor 24. In this manner, the air/fuel ratio is continuously adjusted to maintain optimum combustion conditions in view of changes in the operating variables.

Now referring to FIGS. 2–6, there is illustrated in greater detail the operation of the oxygen trim control actuator 34. The actuator 34 includes a housing or body portion 52 suitably mounted in the linkage connection between the jackshaft 18 and the damper 40. The input arm 32 is pivotally connected by a pin 54 to the housing 52. In a similar manner, the output shaft 35 is pivotally mounted a preselected position from the input shaft 32 on the housing 52 by a pin 56. The input arm 32 includes a longitudinally extending slot 58. The linkage 30 from the jackshaft 18 is suitably connected as by a swivel 60 to the input arm 32 within the slot 58. The swivel 60, and therefore the connection of the linkage 30 to the input arm 32, is adjustable in the slot 58 between the pivot pin 54 and the end of the slot 58 at the outer end of the input shaft 32.

In a similar arrangement, the output shaft 35 includes a longitudinally extending slot 62 for receiving a swivel 64 connected to the linkage 36 to the damper 40. The point of connection of the linkage 36 to the output shaft 35 is adjustable in the slot 62 between the pivot pin 56 and the outer end of the output shaft 35. Preferably, the distance between pin 56 and the swivel 64 on the output shaft 35 should be equal to the distance between the pivot pin 54 and the swivel 60 in the input shaft 32.

Figure 3:
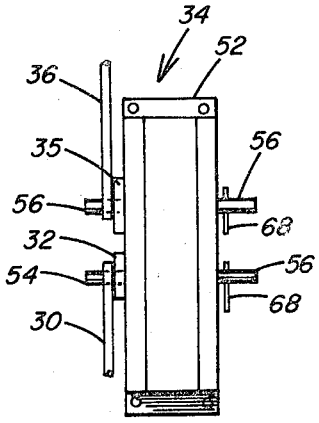
FIG. 3 is a schematic top plan view of the mechanical amplifier shown in FIG. 2.

Each of the shafts 32 and 35 includes a reference mark 65, which is positioned opposite a scale 66 on the housing 52. The position of the reference mark 65 on the scale 66 indicates the relative pivoted position of the input and output shafts 32 and 35 corresponding to the boiler load and air flow. Similar scales (not shown) may also be positioned on the opposite side of the housing 52, as illustrated in FIG. 3. The scales are referenced by pointers 68 nonrotatably connected to the ends of the pins 56 and 64 opposite the connection of the shafts 32 and 35 to the pins 54 and 56. Thus, rotation of the shafts 32 and 35 is transmitted to the pins 54 and 56 to rotate the pins and indicate the relative positions of the input and output shafts 32 and 35.

Figure 4:
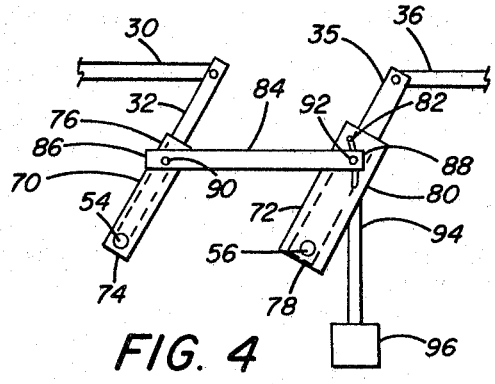
FIG. 4 is a schematic representation of the linkage for the mechanical amplifier shown in FIGS. 2 and 3, illustrating an input arm associated with the fuel control device linked to an output arm associated with the air flow control device.
Figure 5:
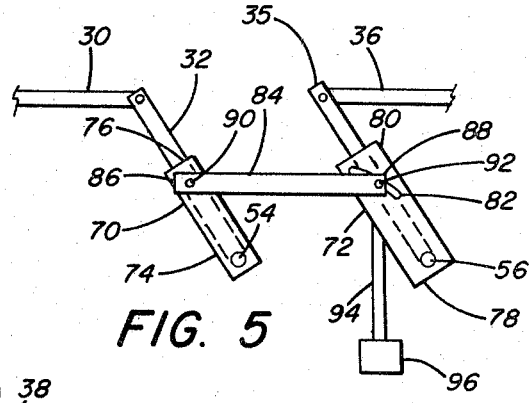
FIG. 5 is a schematic representation, similar to FIG. 4, illustrating the relationship between the position of the input arm and the output arm upon a change in position of the input arm.

Positioned within the actuator housing 52 are a pair of input and output arms 70 and 72, as illustrated in FIGS. 4 and 5, where the housing 52 has been removed for clarity of illustration. The input arm 70 is positioned in overlying relation with the input shaft 32. The input arm 70 has a first end portion 74 nonrotatably connected to the pivot pin 54 to which the input shaft 32 is also nonrotatably connected. The input arm 70 includes a second end portion 76. The output arm 72 is rotatably mounted on the housing 52 a preselected distance from the rotational mounting of the input arm 70 on the housing 52 and in overlying relation with the output shaft 35. The output arm 72 includes a first end portion 78 nonrotatably connected to the pivot pin 56 to which the output shaft 35 is nonrotatably connected. The output arm 72 includes a second end portion 80. The slot 82 forms an arc of a circle having a radius substantially equal to the distance on the actuator housing 52 between the rotational mountings of the input arm 70 and the output arm 72. The slot 82 is shown in the arm second end portion 80 but it should be understood that the slot 82 can be located at any location on arm 72 spaced from the arm first end portion 78.

A link 84 extending between arms 70 and 72 has a first end portion 86 and a second end portion 88. The first end portion 86 is pivotally connected by a pin 90 to the input arm second end portion 76. The link second end portion 88 is also provided with a pin 92 which is positioned in the arcuate slot 82 to connect the link 84 to the output arm second end portion 80. The length of the link is substantially equal to the distance between the rotational mountings of the input arm 70 and the output arm 72 on the actuator housing 52.

The position of the pin 92 in the slot 82 is adjustable for making corrections in the damper position to change the air flow to the boiler in response to changes in the combustion condition of the boiler. The pin 92 on the end of the link 84 is suitably connected by a linkage 94 or the like, to a suitable power driven device 96, such a screw motor. Actuation of the motor 96 moves the linkage 94 to, in turn, raise or lower the position of the pin 92 in the slot 82. For example, a conventional ball screw (not shown) is rotated by the screw motor 96 to advance along the ball screw a nut connected to the pin 92. However, it should be understood that other well-known devices, such as a rack and gear, scissors mechanism or a direct coupling to motor 96, can be utilized to change the position of the pin 92 in the slot 82. This operation is initiated by an electrical signal transmitted by the controller 48 to the motor 96 in response to a signal from the sensor 42 detecting an excess amount of air in the stack emissions. Upon receipt of the signal from the sensor 42, the controller 48 transmits a responsive signal to actuate the motor 96 and adjust the position of the pin 92 in slot 82 to make the required correction to the damper position and regulate the air flow to the boiler in order to reduce the percentage of excess air in the stack emissions.

Referring to the embodiment of the linkage 30 illustrated in FIGS. 4 and 5, the pin 92 is centered in the slot 82. FIG. 4 illustrates the input arm 70 positioned in a first or "zero" position and the output arm 72 positioned in a corresponding position. FIG. 5 illustrates the input arm 70 pivoted, upon movement of the input shaft 32 from the first or "zero" input position to a second or "full" travel input position. At the "zero" input position, the damper 40 is closed and the flow of fuel to the combustion chamber is terminated.

With the pin 92 centered within the slot 82 corresponding to the "zero" input position, movement of the input arm 70 generates pivotal movement of the output arm 72 and corresponding movement of the output shaft 35 connected to the damper 40. With the pin 92 in the "zero" input position, movement of the input arm 70 generates corresponding movement of the output arm 72. Thus, the position of the output arm 72 does not change relative to the position of the input arm 70 upon movement of the input arm 70 when the pin 92 is in the "zero" input position in slot 82.

The range of movement of the input arm 70 initiated by the input shaft 32 between the first and second positions, as illustrated in FIGS. 4 and 5, is the same as the range of movement of the output arm 72 between the first and second positions. However, when the pin 92 is moved by operation of the motor 96 to an upper position in the slot 82, the range of movement of the output arm 72 is less than the corresponding range of movement of the input arm 70. Conversely, when the pin 92 is moved by actuation of the motor 96 to a lower position in the slot 82, the range of movement of the output arm 72 is greater than the corresponding range of movement of the input arm 70. In this manner, the air trim control actuator 34 is operable as a mechanical amplifier in the air damper linkage where the "gain" of the amplifier is set by the controller 48.

Figure 8:
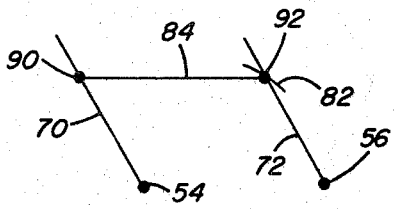
FIGS. 8–10 are schematic representations of the input and output arms, illustrating adjustments in the range of movement of the output arm relative to the input arm.
Figure 9:
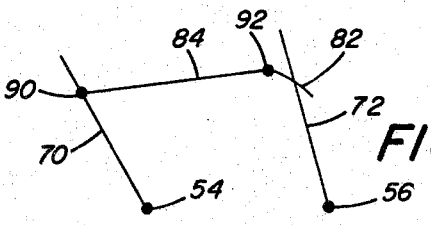
Figure 10:
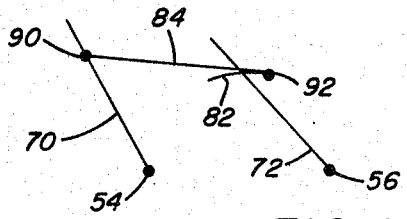

For example, FIG. 8 illustrates schematically the relative positions of the arms 70 and 72 for the position of the pin 92 centered in the slot 82. It will be noted that the input and output arms 70 and 72 are positioned in relatively parallel relation. However, when the pin 92 is raised in the slot 82, the range of movement of the output arm 72 is less than the range of movement of the input arm 70. This adjusted position of the output arm 72 relative to the input arm 70 is illustrated in FIG. 9. Correspondingly, when the pin 92 is lowered in the slot 82, the range of movement of the output arm 72 exceeds the range of movement of the input arm 70. This adjusted position is illustrated in FIG. 10. Thus, when the pin 92 is moved in the slot 82 out of the "zero" input position, the input and output arms 70 and 72 are no longer maintained in parallel relation upon movement of the input arm 70 and the range of movement between the input and output arms is no longer 1:1. Also, it should be understood, the further the output arm 72 rotates, the more effect the slide position of the link 84 on the output arm 72 has on the rotation of the output arm 72 and correspondingly, the output to the output shaft 35 and movement of the damper 40.

Figure 6:
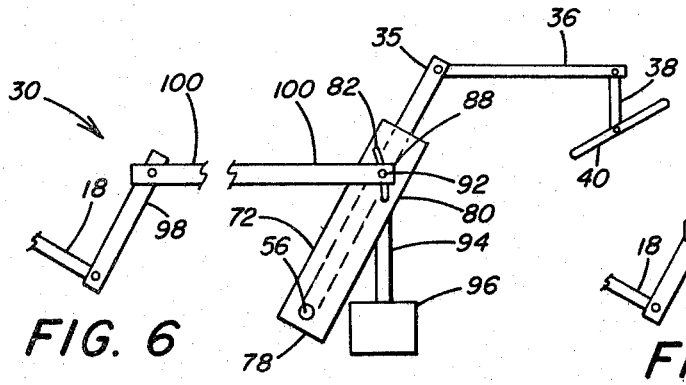
FIG. 6 is a schematic representation similar to FIG. 4, illustrating an additional embodiment of the linkage for the mechanical amplifier.
Figure 7:
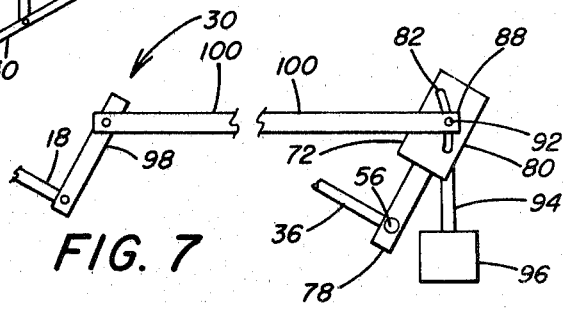
FIG. 7 is another schematic representation, illustrating a further embodiment of the linkage for the mechanical amplifier.

In accordance with the present invention, the linkages illustrated in FIGS. 6 and 7, as well as the linkage illustrated in FIGS. 4 and 5, are also operable to connect the jackshaft 18 to the fuel valve 14 shown in FIG. 1. With this arrangement, adjustments are automatically made in the flow rate of fuel to the boiler 12. Therefore, it should be understood that the linkages described hereinabove and hereafter are not limited to control of the damper but are also operable to control operation of the fuel valve and the rate of flue flow to the boiler.

Now referring to FIG. 6, there is illustrated another embodiment of the linkage for connecting the jackshaft 18 to the damper 40. In FIG. 6, like numerals refer to like elements of FIGS. 4 and 5. The jackshaft 18 is connected by the linkage 30 directly to the output arm 72 thereby deleting the connection of input arm 70 and link 84 to the output arm 72, illustrated and described above for FIGS. 4 and 5.

In FIG. 6, however, the linkage 30 includes intermediate links 98 and 100 where link 98 connects jackshaft 18 to link 100 and link 100 carries the previously described pin 92 in the arcuate slot 82 of the output arm 72. The operation of the output arm 72 movable relative to the pin 92 in slot 82 is identical to the same arrangement discussed above for FIGS. 4 and 5. Accordingly, movement of the jackshaft 18 is transmitted by links 98 and 100 to the output arm 72 to, in turn, move the output shaft 35 to generate movement of the linkages 36 and 38 for selectively positioning the air damper 40 to attain the optimum air/fuel ratio for the set boiler load.

FIG. 7 illustrates a modification to the embodiment of the linkage shown in FIG. 6. In FIG. 7, the output shaft 35 connecting the output arm 72 to the linkages 36 and 38 has been deleted and the output arm 72 is directly connected to the linkages 36 and 38 and the damper 40. The connection to the damper 40 and specifically the connection to linkage 36 is made at the output arm first end portion 78. The pin 56 carried by the arm first end portion 78 is connected to one end of linkage 36 which is connected as above described to the damper 40. Thus, it will be apparent that various modifications can be made to the linkage for connecting the jackshaft 18 to the damper 40, as well as to the fuel valve 14.

Figure 11:
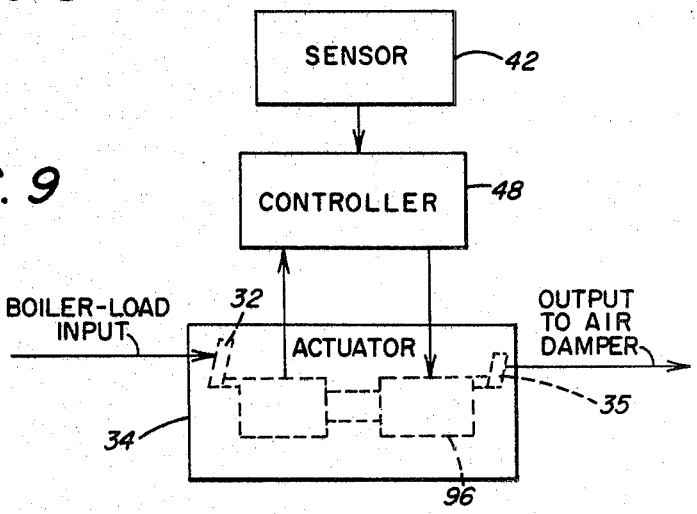
FIG. 11 is a diagrammatic illustration of the interconnection of the mechanical amplifier with the system controls for operating the mechanical amplifier.

Now referring to FIG. 11, there is diagrammatically illustrated the operation of the oxygen trim control actuator 34 to maintain the optimum air/fuel ratio of the combustion process. As stated above, the boiler technician or the automatic controller initially determines the desired set point for the volumetric rate of fuel flow to the boiler. When the desired boiler load is set, the drive motor 24 is actuated and the jackshaft 18 is rotated a preselected degree and the input shaft 32 to the actuator 34 is moved through the linkage 30. Accordingly, input to the actuator 34 is mechanical motion which is converted to an electrical signal and transmitted back to the controller 48. Input to the actuator 34 generates movement of the input shaft 32, input arm 70, output arm 72 and output shaft 35 and moves the linkages 36 and 38 for selectively positioning the damper 40 to attain the optimum air/fuel ratio for the set boiler load.

The oxygen sensor 42 continuously monitors the level or percentage of excess oxygen in the gases flowing through the stack 44 from the boiler 12. In the event of a variation of fuel/heat value, oil viscosity, gas density, barometric pressure, air temperature and humidity, burner condition and the like, the sensor 42 will detect a deviation from the optimum level of excess oxygen present in the stack emissions for efficient combustion.

When a deviation is detected in the optimum level of excess oxygen, the sensor 42 initiates an electrical input signal to the controller 48. The controller 48 compares the input from the sensor with the desired set point for the boiler load. The controller 48 then initiates a correction action signal to the actuator motor 96.

The output signal from the controller 48 initiates operation of the motor 96 for a predetermined amount of time to permit adjustments to be made in the position of the pin 92 in the slot 82 of the output arm 72. Depending upon the need to increase or decrease the percentage of excess oxygen in the stack emissions, the pin 92 is moved either up or down in the slot 82 by the motor 96 and linkage 94. The amount of movement of the pin 92 in the slot 82 is determined by the controller 48 based upon the input signal from the sensor 42 and the programmed boiler load. By changing the range of motion of the output arm 72 and the output shaft 35 in relation to the input shaft 32 and input arm 70, the position of the damper is adjusted. Thus, the air/fuel ratio is adjusted to maintain the desired percentage of excess oxygen in the stack emissions to maintain the optimum air/fuel ratio for the most efficient combustion.

Following the correction to the flow of air through the damper 40 to the boiler, operation of the actuator motor 96 is terminated for a period of time. After lapse of the preprogrammed period, the actuator motor 96 is again operated if necessary. In this manner, the air/fuel ratio is continuously adjusted to maintain optimum combustion in the boiler.

According to the provisions of the patent statutes, I have explained the principle, preferred construction and mode of operation of my invention and have illustrated and described what I now consider to represent its best embodiments. However, it should be understood, that within the scope of the appended claims, the invention may be practiced otherwise than as specifically illustrated and described.

I claim:

1. An actuator for automatically adjusting the ratio between the flow of air and the flow of fuel in combustion apparatus comprising, an input arm responsive to an input signal, said input arm having a first end portion and a second end portion, said first end portion being pivotally mounted for arcuate movement of said input arm between a zero input position and a full input position, an output arm of a fixed length for generating an output signal, said output arm positioned adjacent to said input arm, said output arm having a first end portion and a second end portion, said output arm first end portion being pivotally mounted for arcuate movement of said output arm, said output arm having a slot of a preselected length spaced from said output arm first end portion, said slot forming an arc of a circle having a radius substantially equal to the distance between the point of pivotal mounting of said input arm first end portion and the point of pivotal mounting of said output arm first end portion, a link extending between said input and output arms, said link having a first end portion pivotally connected to said input arm whereby the point of connection of said link first end portion to said input arm is the center of said radius of said arcuate slot, said radius center corresponding to the pivotal connection of said link first end portion to said input arm when said input arm first end portion is in said zero position, said link having a second end portion, means for connecting said link second end portion to said output arm slot for movement of said link second end portion to a preselected position in said slot to adjust the pivotal radius between said output arm first end portion and the point of connection of said link second end portion on said output arm, said input arm being pivoted in response to an input signal to a preselected position to move said link and pivot said output arm to a preselected position for generating a corresponding output signal, and said link second end portion being movable within a predetermined range to a preselected position in said slot to change the point of connection of said link second end portion on said output arm independently of the position of said input arm and thereby adjust the range of movement of said output arm in relation to the range of movement of said input arm in response to changes in the measured oxygen valve.

2. An actuator as set forth in claim 1 which includes, signal input means for applying an input signal to said input arm to move said input arm to a preselected pivoted position corresponding to a predetermined fuel flow, and said output arm being pivoted to a preselected position in response to movement of said input arm to generate an output signal proportional to a predetermined air flow corresponding to the predetermined fuel flow.

3. An actuator as set forth in claim 1 in which, said input arm has a preselected range of movement where said input signal generates movement of said input arm to a preselected position corresponding to a predetermined fuel flow, and said output arm having a preselected range of movement where the movement of said input arm in response to said input signal moves said output arm to a preselected position for generating said output signal representing a predetermined air flow corresponding to said predetermined fuel flow.

4. An actuator as set forth in claim 1 which includes, actuator means connected to said link second end portion for moving said link second end portion to a preselected position in said output arm slot, and said link second end portion being movable to a preselected position in said slot by operation of said actuator means to adjust the range of movement of said output arm relative to the range of movement of said input arm and generate an adjusted output signal.

5. An actuator as set forth in claim 1 in which, said input arm first end portion is movable between a zero input position and a full input position, and said output arm remaining in a preselected position relative to said input arm for said zero input position of said input arm as said link second end portion moves in said slot.

6. A method for automatically controlling the input signals to first and second flow control devices interconnected by a linkage in combustion apparatus comprising the steps of, applying an input signal substantially proportional to the magnitude of flow from the first control device to an input arm, pivotally connecting said input arm to an output arm by a link, positioning the end of said link in an arcuate slot of said output arm for movement of said link within a predetermined range to a preselected position on said output arm, said slot having a preselected radius measured from the pivotal connection of said link to said input arm to said slot, pivoting said output arm in response to movement of said input arm through a preselected range of movement, transmitting an output signal upon movement of said output arm to said second flow control device, the movement of said output arm and the magnitude of said output signal being proportional to the range of movement of said input arm, moving the point of connection of said link to said output arm along an arcuate path to a preselected position in said slot on said output arm to change the length of the pivotal radius between the pivot point of said output arm and the point of connection of said link on said output arm without changing the length of said link or the relative position of said input arm to thereby adjust the range of movement of said output arm in relation to the range of movement of said input arm, and adjusting the magnitude of said output signal to said second flow control device in response to the change of position of said link on said output arm.

7. A method as set forth in claim 6 which includes, transmitting a correction signal to the end of said link to selectively move said link to an adjusted position on said output arm, and adjusting the range of movement of said output arm to adjust said output signal to said second flow control device in reponse to said correction signal.

8. A method as set forth in claim 8 which includes, adjusting the position of said link in said slot on said output arm to vary the range of movement of said output arm in relation to the range of movement of said input arm to change the magnitude of said output signal in relation to said input signal without changing the position of said input arm.

9. A method as set forth in claim 8 which includes, pivotally connecting one end of said link to said input arm and positioning the opposite end of said link in a preselected position in a slot of said output arm, and pivoting said link one end on said input arm to move the said link opposite end to a preselected position in said slot where the connection of said link to said input arm is the center of the radius of said slot.

10. An actuator for automatically adjusting the ratio between two flow control devices in combustion apparatus comprising, an actuator body, an input arm responsive to an input signal and having first and second end portions, said input arm first end portion being rotatably mounted to said actuator body for pivotal movement between a zero input position and a full input position, an output arm for generating an output signal, said output arm having a fixed length with said first and second end portions, said output arm first end portion being rotatably mounted on said actuator body a preselected distance from said input arm, an arcuate slot in said output arm second end portion, said slot forming an arc of a circle having a radius substantially equal to the distance on said actuator body between said rotational mountings of said input and said output arms, a link of a fixed length substantially equal to the distance between said rotational mountings of said input and said output arms, said link connecting said input arm second end portion to said output arm second end portion, a pin connected to said link and slidable in said arcuate slot of said output arm second end portion, said output arm second end portion being adjustably connected to said link by said pin slidable in said slot whereby movement of said pin in said slot at said zero flow position of said input arm does not change the position of said output arm relative to the position of said input arm at said zero position, and means for moving said pin through a predetermined range to a preselected position in said slot to change the pivotal radius between said output arm first end portion and the point of connection of said link to said output arm second end portion to change the position of said output arm and the magnitude of the output signal without changing the position of said input arm and the magnitude of the input signal.

11. An actuator as set forth in claim 10 wherein said means for moving said pin in said slot changes the rotation of said output arm relative to said input arm when said input arm is rotated away from said zero input position.

12. An actuator as set forth in claim 10 which includes, means for rotating said input arm out of said zero input position in response to a preselected fuel flow, and means operatively connected to said output arm for controlling air flow at a predetermined rate corresponding to the rate of fuel flow.

13. An actuator as set forth in claim 12 in which, said means for moving said pin in said arcuate slot changes the rate of air flow relative to fuel flow when said input arm is rotated away from said zero input position.

14. An actuator as set forth in claim 10 in which, said means for moving said pin in said slot includes a power actuated device connected to said pin, and said power actuated device being operable to move said pin to a preselected position in said slot to control the range of pivotal movement of said output arm in response to the pivotal movement of said input arm.

15. A method for automatically controlling the relative input signals to first and second flow control devices interconnected by a mechanical linkage in a combustion apparatus responsive to combustion conditions comprising the steps of, applying an output signal substantially proportional to the magnitude of flow from the first flow control device to the input arm of a mechanical linkage, pivoting said input arm through a preselected range of movement from a zero input position to a full input position in response to flow from said first flow control device, connecting said input arm to said output arm by a connecting link, pivoting said output arm in response to movement of said input arm to control flow from said second flow control device, measuring the combustion conditions, and changing the rate of said second flow responsive to said combustion conditions by selectively moving the point of connection of said connecting link to said output arm to a preselected position along an arcuate path of a predetermined range and a radius substantially equal to the distance between the pivotal mountings of said input and output arms to adjust the pivotal radius of said output arm to change the rotation of said output arm relative to said input arm without changing the degree of rotation of said input arm or changing the length of either said connecting link or said output arm or changing the relative position of said input arm and said output arm at the zero input position.

16. A method as set forth in claim 15 which includes, connecting said link to said output arm for slidable movement of said link on said output arm, and adjusting the position of said link on said output arm by sliding said link to a preselected position on said output arm to change the effective length of said output arm.

17. A method as set forth in claim 15 which includes, pivotally supporting said input and output arms, connecting said input and output arms by said link such that pivotal movement of said input arm is transmitted to said output arm, slidably connecting said link to said output arm to change the effective length of said output arm, and selectively slidably positioning said link on said output arm to generate pivotal movement of said output arm through a preselected range of movement in relation to the range of pivotal movement of said input arm.

* * * * *